US005819510A

United States Patent [19]

Bochtler et al.

[11] Patent Number: 5,819,510

[45] Date of Patent: Oct. 13, 1998

[54] PACKAGING MACHINE HAVING A CHAMBER CONSISTING OF AN UPPER PART AND A LOWER PART

[75] Inventors: Alois Bochtler, Egg; Josef Mayer, Memmingerberg, both of Germany

[73] Assignee: Dixie-Union GmbH & Co. KG, Kempten, Germany

[21] Appl. No.: 990,613

[22] Filed: Dec. 15, 1997

[30] Foreign Application Priority Data

Dec. 14, 1996 [DE] Germany ..... 296 21 761 U

[51] Int. Cl.[6] ..... B65B 43/08; B65B 61/00

[52] U.S. Cl. ..... 53/559; 493/169

[58] Field of Search ..... 53/453, 559, 374.8; 493/169, 170

[56] References Cited

U.S. PATENT DOCUMENTS

| | | | |
|---|---|---|---|
| 3,343,336 | 9/1967 | Bradford . | |
| 3,766,702 | 10/1973 | Meissner et al. | 53/453 |
| 3,808,772 | 5/1974 | Turtschan | 53/141 |
| 3,837,782 | 9/1974 | Meissner et al. | 425/347 |
| 3,958,394 | 5/1976 | Mahaffy et al. . | |
| 4,209,957 | 7/1980 | Utzmann | 53/453 |
| 4,730,761 | 3/1988 | Spano | 53/559 X |
| 5,269,123 | 12/1993 | Marchesini | 53/559 |
| 5,623,810 | 4/1997 | Dey et al. | 53/453 X |
| 5,644,895 | 7/1997 | Edwards et al. | 53/559 X |

FOREIGN PATENT DOCUMENTS 2139141 1/1973 France .

*Primary Examiner*—Horace M. Culver
*Attorney, Agent, or Firm*—Jacobson, Price, Holman & Stern, PLLC

[57] ABSTRACT

A packaging machine for the working and processing of at least one length of foil has a chamber consisting essentially of an upper part (1) and a lower part (2). The chamber parts (1,2) are moveable relative to one another on guides (6) on both sides of the foil (24) by means of at least one cylinder-piston arrangement (3) which drives a toggle lever arrangement (4,5). The cylinder-piston arrangement (3) is arranged in the median plane (7) between the guides (6) and drives the toggle lever arrangement (4,5) in the same way under the ends (8) of the guides (6), the toggle lever arrangement (4,5) driving the lower part (2). The toggle lever arrangement (4,5) is operably connected to a liftable and lowerable yolk (11) such that during lifting movement of the lower part (2) the yolk (11) descends, and vice versa, and the yolk (11) is rigidly connected to the upper part (1).

7 Claims, 3 Drawing Sheets

PACKAGING MACHINE HAVING A CHAMBER CONSISTING OF AN UPPER PART AND A LOWER PART

FIELD OF THE INVENTION

The invention relates to a packaging machine having a chamber consisting essentially of an upper part and a lower part, for the working and processing of at least one length of foil, the chamber parts being movable relative to one another on guides on both sides of the foil by means of at least one cylinder-piston arrangement which drives a toggle-lever arrangement.

DESCRIPTION OF THE PRIOR ART

Packaging machines for the packaging, for example, of foodstuffs between two lengths of foil have working stations which are constructed as chambers and as a rule consist of an upper part and a lower part. These chambers serve, for example, for the shaping of troughs in the lower foil, which then receive the products to be packaged. However, they also serve as a station for the welding of the trough to an upper foil as well as the evacuation of the interior of the packaging.

In many cases, it is sufficient for the opening and closing movement of the chamber to be executed only by the lower part, the upper part not altering its vertical position. In some cases, however, it is also desirable to provide the upper foil with troughs or bulges, for example when the products project upwards. In this case, the upper part of the chamber also has to be moved vertically during the closing and opening movement, in the opposite direction to the lower part.

BRIEF SUMMARY OF THE INVENTION

It is the object of the invention to provide a packaging machine in which there are exact opening and closing movements of the chamber parts, and which also allows rapid movement of the chamber parts.

In order to achieve this and other objects, the invention starts from a packaging machine of the general type described at the outset. According to the invention, the cylinder-piston arrangement is arranged in the median plane between the guides and drives the toggle-lever arrangements in the same way under the ends of the guides, the toggle-lever arrangements driving the lower part. The toggle-lever arrangements each also have operable connections to a liftable and lowerable yoke, such that during lifting movement of the lower part the yoke descends, and vice versa, and the yoke is rigidly connected to the upper part.

The invention thus uses the cylinder-piston arrangement known per se for driving a toggle-lever arrangement, which acts on the lower part. The same drive is also used in the invention, however, to drive the upper part, in particular by means of the same driving elements.

The arrangement according to the invention is advantageous in that, besides the fact that there is a simple simultaneous drive, the weight forces of the two chamber parts are directed against one another, with the result that a balance is achieved and only small driving forces are necessary.

Large opening movements can also be achieved, it generally being the case (though not necessarily so) that the opening movement of the lower part is greater than the opening movement of the upper part. Since the required overall stroke is the sum of two movements, the stroke movements can also be executed more quickly, without excessive acceleration forces occurring and corresponding drives being necessary.

The drive for the chamber of the packaging machine according to the invention can be accommodated under the chamber, so that there is no additional space requirement and the external dimensions of the machine are not increased.

In a refinement of the invention there is provision for the guides for the chamber parts also to form the elements connecting the yoke to the upper part. The lower part of the chamber or the associated support moves, during its stroke movement, along the guides, which for their part carry and move the upper part.

In a preferred embodiment of the invention, the toggle-lever arrangements have a pivot shaft with two pivoted levers, one of which is driven by the cylinder-piston arrangement and the other of which drives the lower part. This design has the advantage that the work output of the cylinder-piston arrangement can be optimally utilised, but on the other hand it is also possible, in the locked position, to achieve a dead centre position of the toggle-lever arrangement which ensures an exact closure of the chamber parts.

The drive of the yoke for the upper part may, for example, likewise be a toggle-lever arrangement. A simple design may be obtained when the shaft for the toggle-lever drive of the lower part carries and drives a pivot journal which engages in an elongate opening of the yoke. With appropriate orientation of the levers for this pivot journal and of the elongate hole, a dead centre position can likewise be achieved in the closed position.

As already stated, a single cylinder-piston arrangement is sufficient for the invention in order to drive the two chamber parts. The cylinder-piston arrangement preferably drives a crosspiece, at the ends of which there is arranged a respective link for connection to the one pivoted lever of the respective toggle-lever arrangement. By means of a link, the connection of the other pivoted lever to the lower part or its support is established.

The invention proposes, in a preferred embodiment, that the crosspiece is connected to the cylinder of the cylinder-piston arrangement and the piston rod is supported on the machine frame. In this case, a respective crosspiece may be provided on the cylinder, on both sides relative to the direction in which the foil runs, so that four toggle-lever arrangements and four guides for the chamber parts can be driven.

DETAILED DESCRIPTION OF PREFERRED EMBODIMENT

Figure 3:
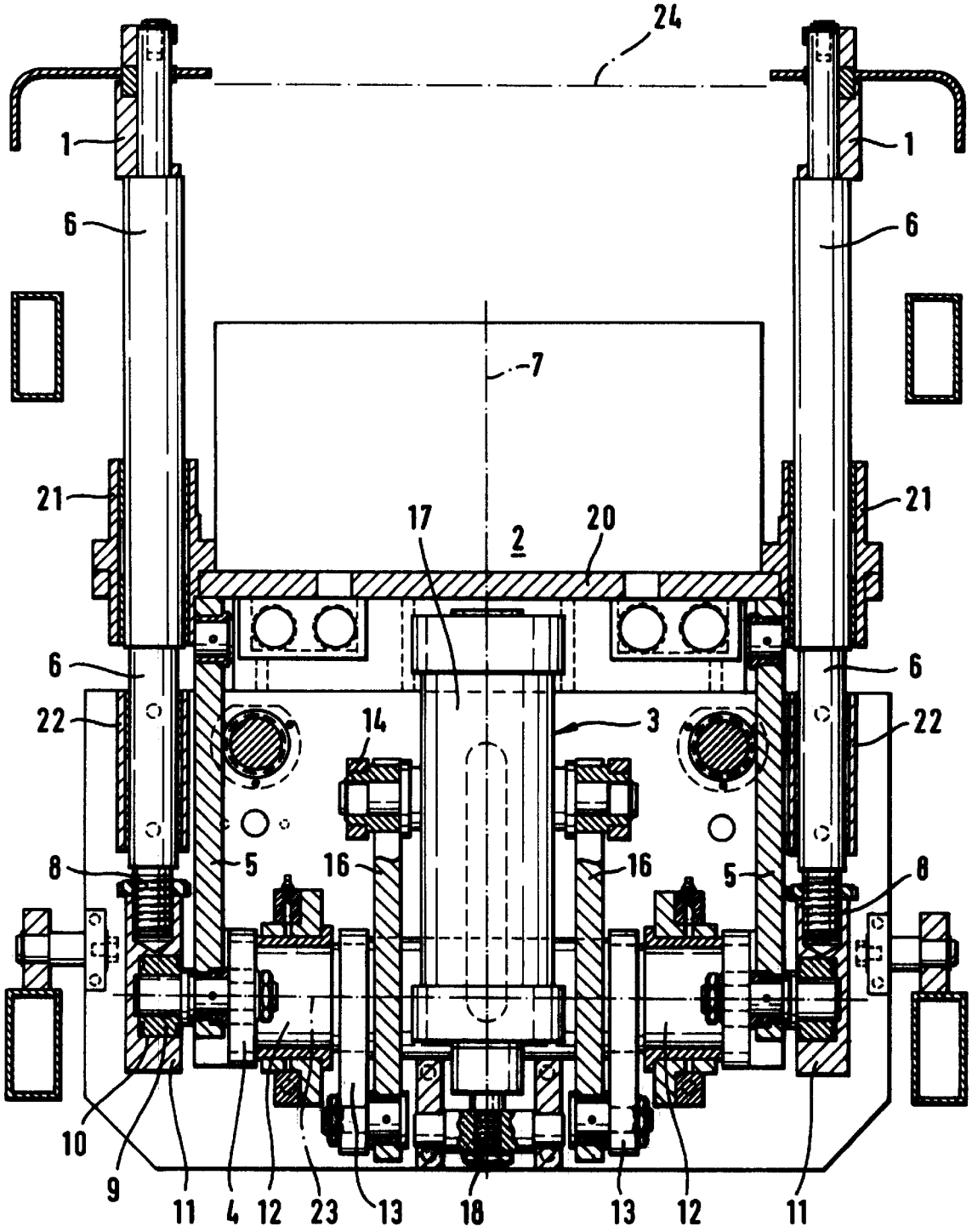
FIG. 3 is a cross-section through the machine in the position of FIG. 1.

Referring first to FIG. 3, a packaging machine has a lower part 2 and an upper part 1, which is only partially represented.

The upper part 1 is mounted on the upper ends of guides 6, the lower part 2 being mounted on a support 20, which is connected to guide sleeves 21 encompassing the guides 6.

The guides 6 are movably guided in tubes 22 on the machine frame 19 and each of their lower ends 8 engage in a yoke 11. Provided on both sides of a length of foil 24, which runs between the upper part 1 and the lower part 2, are the respective guides 6. The median plane between the guides 6 is denoted by 7.

Provided in the median plane 7 is a cylinder-piston arrangement 3, which consists essentially of a cylinder 17 and a piston rod 18. The lower end of the piston rod 18 is held in the machine frame 19.

The cylinder 17 carries on both sides a respective crosspiece 14 and, at the ends 15 of these crosspieces 14, respective links 16 projecting essentially downwards are movably held. The lower ends of the links 16 are connected in articulated fashion to pivoted levers 13. These pivoted levers 13 are seated on a pivot shaft 12 and are movable about an axis 23. The pivot shaft 12 farther carries a pivoted lever 4 of a toggle-lever arrangement. This pivoted lever 4 is connected in articulated fashion to a respective link 5, this link 5 projecting essentially upwards and being articulated on the guide sleeves 21.

The pivot shaft 12 further carries in addition an eccentrically arranged pivot journal, which likewise moves about the axis 23 during the rotation of the pivot shaft 12. This pivot journal 9 engages in an elongate hole 10 of the yoke 11, a respective yoke 11 being arranged on both sides of the median plane 7.

Figure 1:
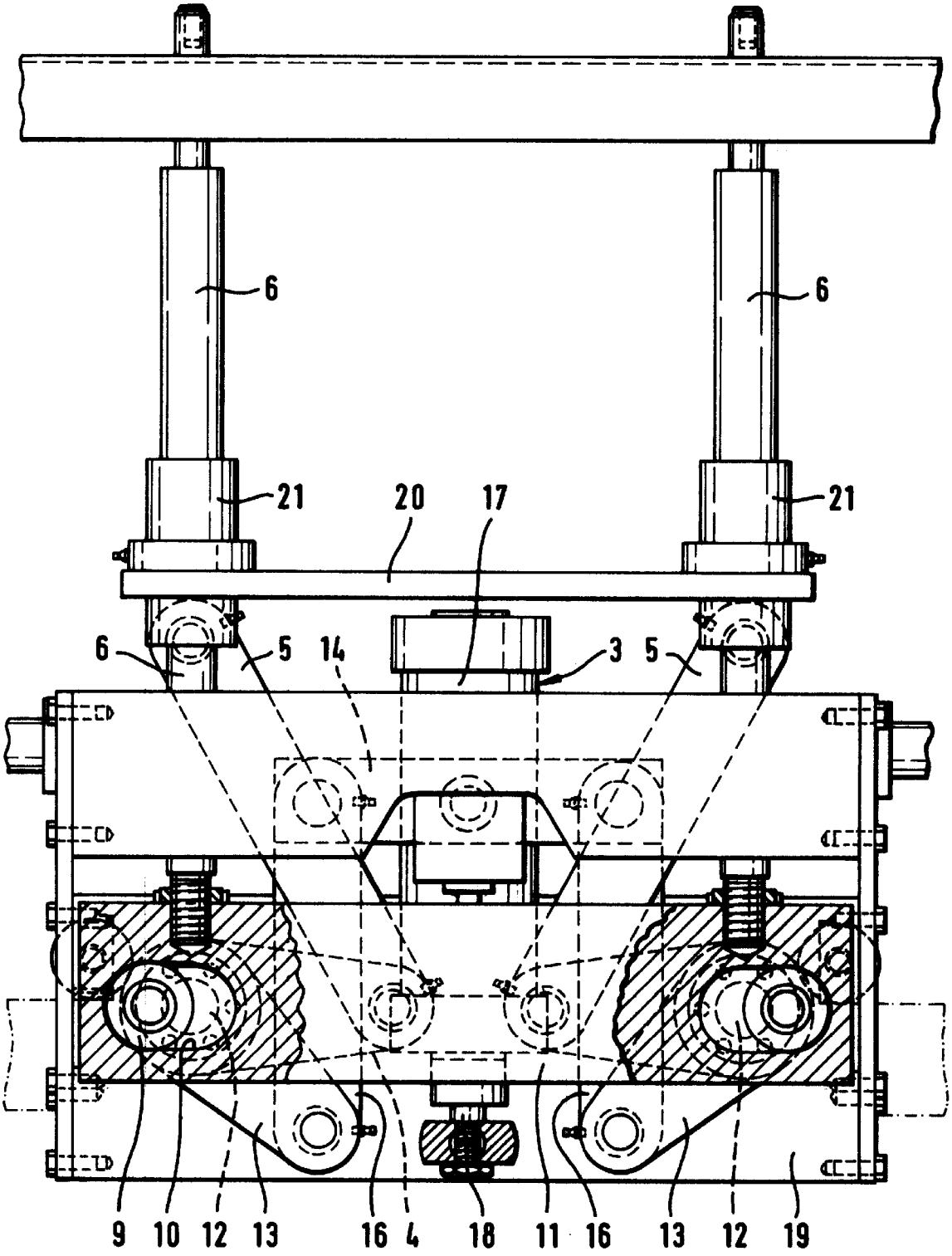
FIG. 1 shows a view, partially in section, of part of a packaging machine according to the invention, the machine having a chamber which is shown in an open position.

In the position shown in FIG. 1, the cylinder 17 is in its lowermost position and accordingly the links 16 also assume the lowermost position. Since the levers 4 of the toggle-lever arrangement and the pivoted levers 13 which are connected to the links 16 are each offset by about 45° the pivoted lever 13 projects inwards and downwards at an angle, whereas the lever 4 is oriented essentially horizontally.

Figure 2:
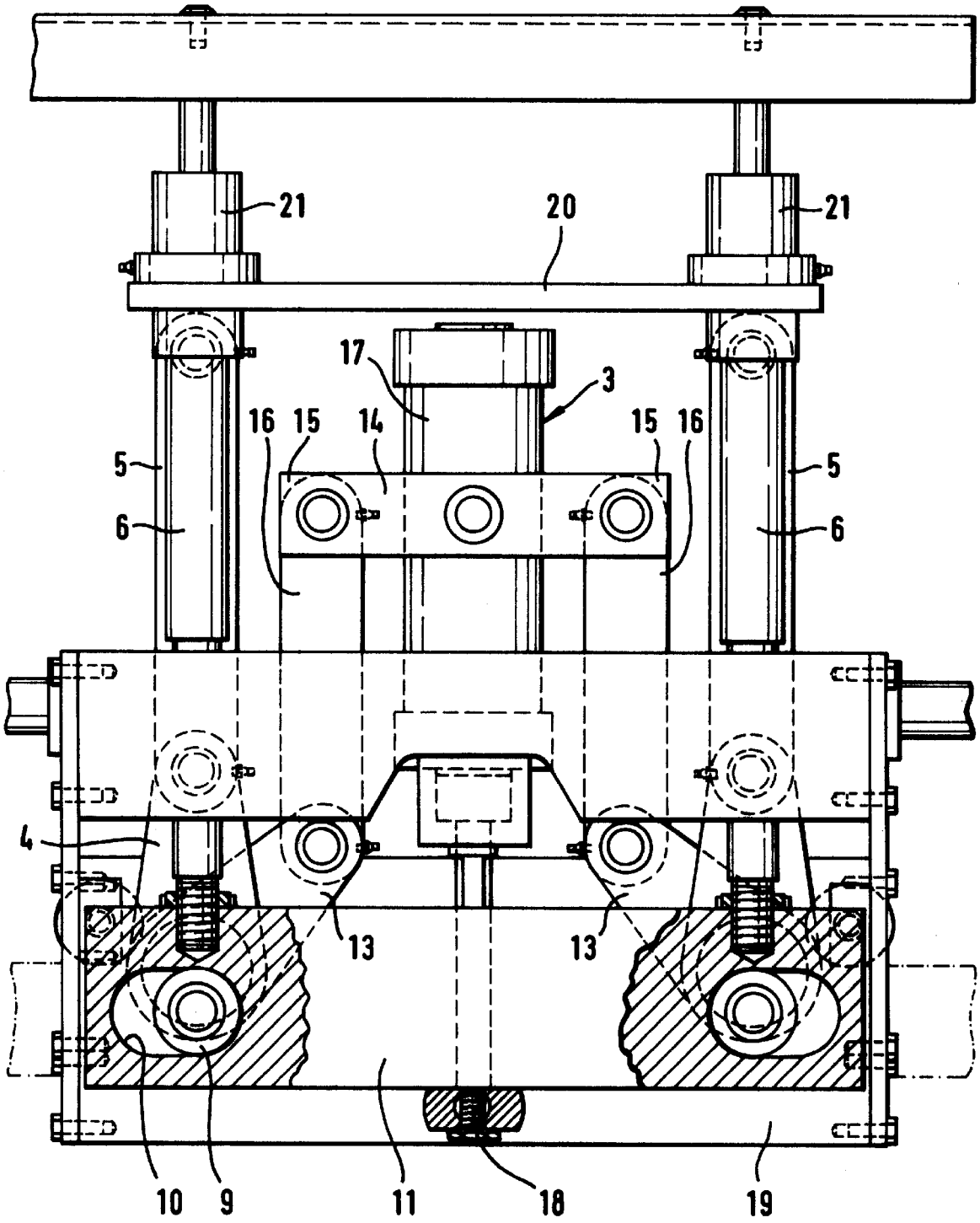
FIG. 2 is a view similar to FIG. 1, but with the chamber closed.

If the cylinder 17 is now actuated, the arrangement pivots from the position shown in FIG. 1 to that of FIG. 2. The pivoted lever 13 is pivoted by about 90° and now projects in each case inwards and upwards, whereas in the end position the lever 4 is directed essentially vertically upwards. Accordingly, the link 5 will execute its maximum stroke movement and the support 17 with the lower part of the chamber reaches a maximum stroke position.

As a rule, an absolute dead centre position is not preferred, the arrangement rather being made such that the lever 4 passes somewhat beyond its vertical position.

Whereas the support 20 with the lower part 2 is raised in this way when the cylinder 17 is actuated, the pivot journal 9 causes, by its engagement in the elongate hole 10, a lowering of the respective yoke 11 and thus also a lowering of the guides 6 with the upper part 1 of the chamber fastened to the upper end of the guides 6. In this way, a countermovement is obtained.

In general, the movement of the lower part of the chamber is substantially greater than the movement of the upper part. Nevertheless, the countermovement quite significantly reduces the driving energy required for the movement of the chamber parts. In particular, the overall travel of the relative movement is also substantially greater than for example the feed travel required for the movement of the lower part.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. Packaging machine for the working and processing of at least one length of foil, said machine having a chamber consisting essentially of an upper part and a lower part, said upper part and lower part being movable relative to one another on guides on both sides of the foil by means of at least one cylinder-piston arrangement which drives a toggle-lever arrangement, wherein said cylinder-piston arrangement is arranged in a median plane between said guides and drives said toggle-lever arrangement in the same way under the ends of the guides, said toggle-lever arrangement driving said lower part, said toggle-lever arrangement being operably connected to a liftable and lowerable yoke such that during lifting movement of said lower part said yoke descends, and vice versa, and said yoke is rigidly connected to said upper part.

2. Packaging machine according to claim 1, wherein said guides form elements connecting said yoke to said upper part.

3. Packaging machine according to claim 1, wherein said toggle-lever arrangement has a pivot shaft with two pivoted levers, one of which is driven by said cylinder-piston arrangement and the other of which drives said lower part.

4. Packaging machine according to claim 3, wherein said pivot shaft engages by a pivot journal in an elongate opening in said yoke.

5. Packaging machine according to claim 1, wherein said cylinder-piston arrangement drives a crosspiece, at the ends of which there is arranged a link for connection to a pivoted lever of said toggle-lever arrangement.

6. Packaging machine according to claim 5, wherein there is further provided a second link for connection of a second pivoted lever to said lower part or a support therefor.

7. Packaging machine according to claim 5, wherein said crosspiece is connected to a cylinder of said cylinder-piston arrangement and a piston rod of said cylinder piston arrangement is supported on the machine frame.

* * * * *